United States Patent [19]

Goeldner

[11] 4,269,264

[45] May 26, 1981

[54] CLEANING OF HEAT EXCHANGER TUBING

[75] Inventor: Richard W. Goeldner, Neptune Beach, Fla.

[73] Assignee: Water Services of America, Inc., Milwaukee, Wis.

[21] Appl. No.: 920,644

[22] Filed: Jul. 3, 1978

[51] Int. Cl.[3] ..... F28G 1/02

[52] U.S. Cl. ..... 165/95; 15/3.5; 15/104.06 R; 134/8; 134/22 C

[58] Field of Search ..... 165/95, 97; 134/8, 21, 134/22 C; 15/3.5, 104.06 R, 104.06 A

[56] References Cited

U.S. PATENT DOCUMENTS

| | | | |
|---|---|---|---|
| 3,123,132 | 3/1964 | Hedgecock | 165/95 |
| 3,169,109 | 2/1965 | Hirs | 165/95 X |
| 3,259,179 | 7/1966 | Leach | 165/95 |
| 3,319,710 | 5/1967 | Heeren | 165/95 |
| 4,025,362 | 5/1977 | Frauenfeld | 165/95 X |

FOREIGN PATENT DOCUMENTS

| | | | |
|---|---|---|---|
| 511383 | 10/1930 | Fed. Rep. of Germany | 165/95 |
| 41-29929 | 3/1966 | Japan | 165/95 |
| 160588 | 3/1921 | United Kingdom | 165/95 |

*Primary Examiner*—Stephen Marcus

*Attorney, Agent, or Firm*—Andrus, Sceales, Starke & Sawall

[57] ABSTRACT

A heat exchanger of the steam condenser type or the like includes a plurality of bundles of tubes through which cooling water is pumped. The downstream ends of the tubes open into a chamber and these ends have basket-brush assemblies thereon. A water back-flow cover traverses progressively across the tube ends, with the cover being fluidically connected to a pump. The pump inlet receives water from the chamber and pumps it back through the tubes at a high pressure, carrying the cleaning brushes with it. When the said cover has passed particular tubes, the brushes in the latter are reversed in direction and carried downstream and back to their original position. The pump may be disposed to suck the water upstream through the tubes, or may be disposed to supply water from upstream of the condenser to the downstream tube ends.

4 Claims, 8 Drawing Figures

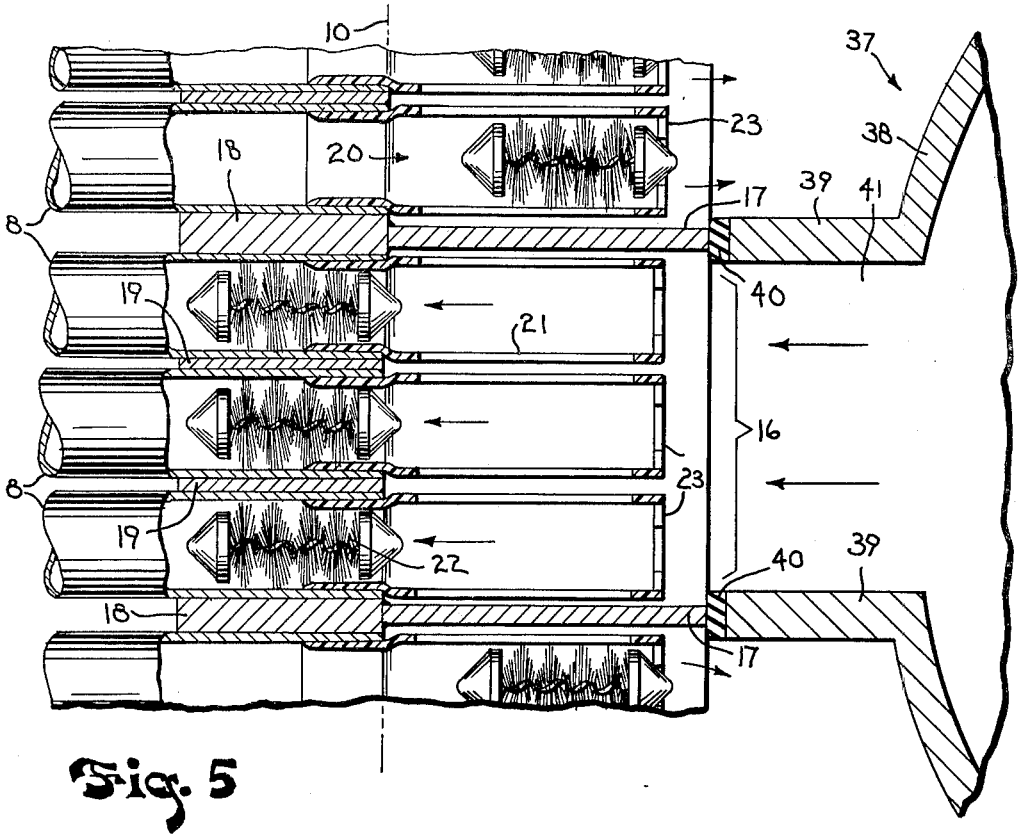
Fig. 5
Fig. 6
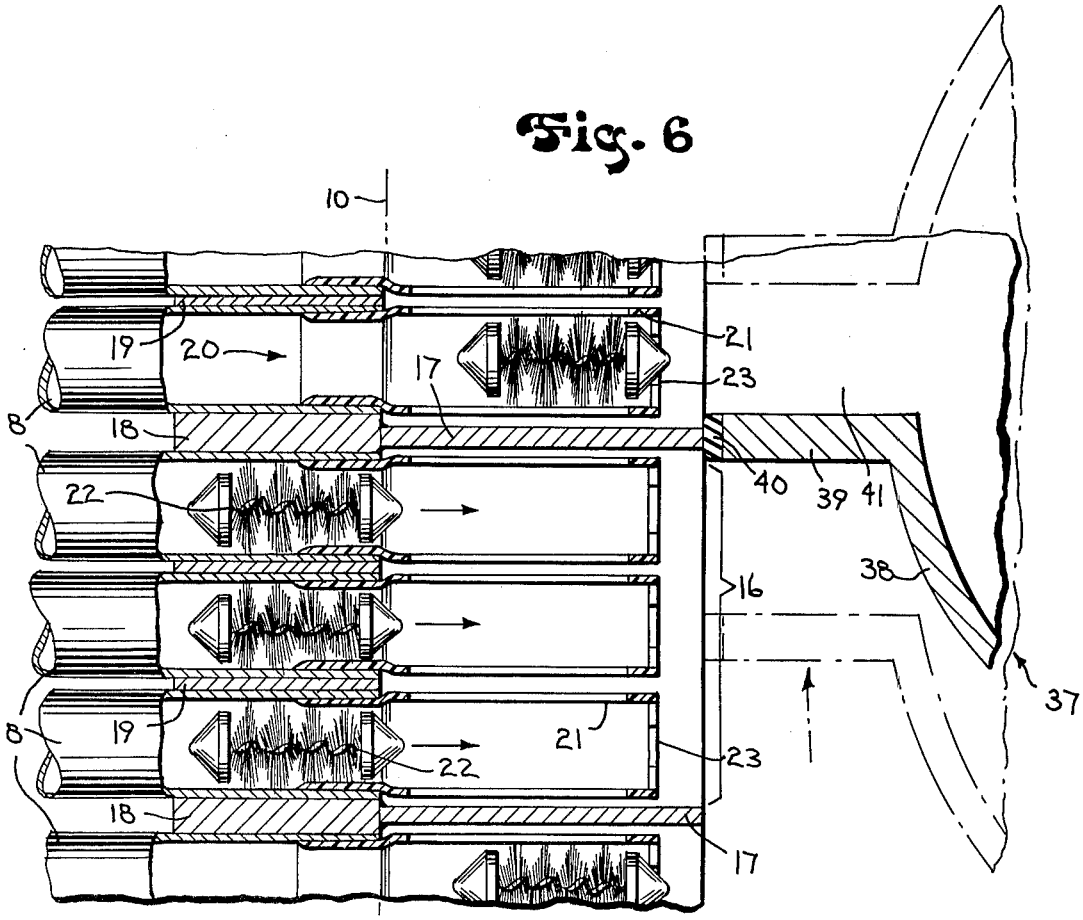

CLEANING OF HEAT EXCHANGER TUBING

PRIOR ART OF INTEREST

| | | |
|---|---|---|
| 3,123,132 | Hedgecock | 3/3/64 |
| 3,169,109 | Hirs | 2/9/65 |
| 3,319,710 | Heeren et al | 5/16/67 |
| 3,548,436 | Ghormley | 12/22/70 |
| 3,973,592 | Cleaver et al | 8/10/76 |
| 4,025,362 | Frauenfeld | 5/24/77 |

BACKGROUND AND SUMMARY OF THE INVENTION

This invention relates to cleaning of tubing of heat exchangers, such as steam condensers.

It has already been suggested that heat exchanger tubing may be internally cleaned by mounting brush-basket assemblies on the ends of the tubes, and then by flowing water first in one direction and then the other to cause the brushes to traverse the length of the tubes and then return to their original positions. See Heeren et al U.S. Pat. No. 3,319,710.

It has also previously been suggested as in Cleaver et al U.S. Pat. No. 3,973,592 to utilize a four-way valve for purposes of reversing the water flow within the tubes to cause the cleaning brushes to move in both directions within the tubes.

Furthermore, the U.S. Ghormley Pat. No. 3,548,438 has suggested that, in the oil well flowline art, a cleaning pig may be caused to flow through a pipe against the fluid pressure in the pipe by pumping fluid from a separate liquid reservoir tank of limited capacity and manually manipulating a plurality of flow control valves.

Also, spraying cleaning fluid through nozzles or the like and into the ends of the heat exchanger members has also been suggested in the other three patents listed above. In those patents, there is relative movement between the nozzles and the heat exchange members.

The aforementioned four-way valve has found substantial application in connection with cleaning of steam condenser tubing wherein the condenser housing is approximately 30" in diameter. However, recent developments have indicated that condenser housings of up to 16' in diameter are now needed in connection with turbo-generation of electricity. To handle such mammoth condensers, a four-way valve would have to be extremely large and would not be practical.

It is a task of the present invention to provide a heat exchanger tubing cleaning system which not only is as efficient as prior systems, but which also eliminates the need for a four-way valve for brush reversal in either small or very large exchangers.

It is a further task of the invention to eliminate the need for a separate source of fluid when providing a fluid backflow, and to provide an unlimited supply of backflow fluid under pressure.

It is an additional task of the invention to provide a force which propels the brushes through the tubes without imposing any additional requirements on the primary circulating pump for the exchanger, the force being applied either continuously or intermittently as desired.

In accordance with one aspect of the invention, a portion of the main stream of cooling water flowing upstream of or through the heat exchanger housing is reversed in direction and is directed back through the compartmentalized tubes at a higher pressure than said stream. A reverse flow of water is thus created which carries with it the cleaning brushes to move them in one direction through the tubes. The capacity of the main water circulating pump need not be varied.

In accordance with a more specific aspect of the invention, a reverse flow pump is disposed downstream of the tubes and receives water discharged from the tubes for pumping the water and brushes backward thereinto. The water is pumped in a reverse direction and progressively into one group of adjacent tubes at a time. The progression across the face of the tube ends may be continuous or step-by-step. Termination of reverse flow and return of the brushes is automatic.

BRIEF DESCRIPTION OF THE DRAWINGS

The accompanying drawings illustrate the best mode presently contemplated by the inventor for carrying out the invention.

In the drawings:

FIG. 5 is a view similar to FIG. 4 showing the back-flow of water within the compartment;

FIG. 6 is a view similar to FIGS. 4 and 5 and showing the progressive movement from compartment to compartment of the back-flow cover;

DESCRIPTION OF THE PREFERRED EMBODIMENT

Figure 1:
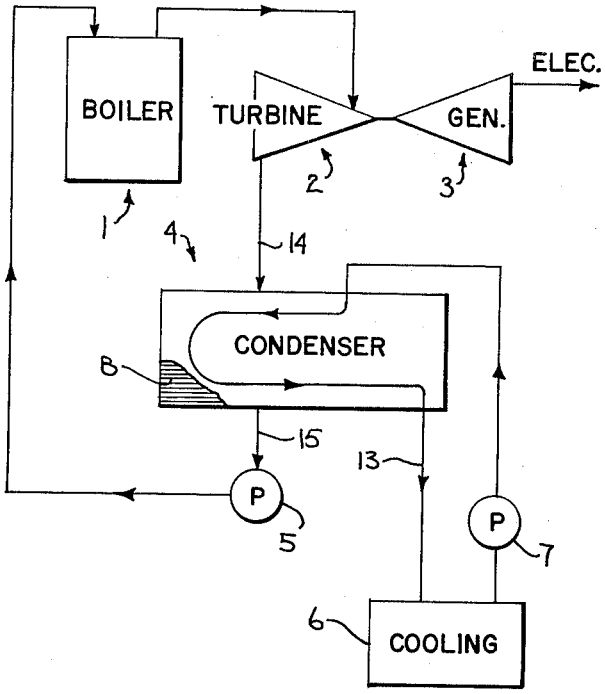
FIG. 1 is a schematic showing of an electric generating system having a steam condenser of the type to which the invention is applied.
Figure 3:
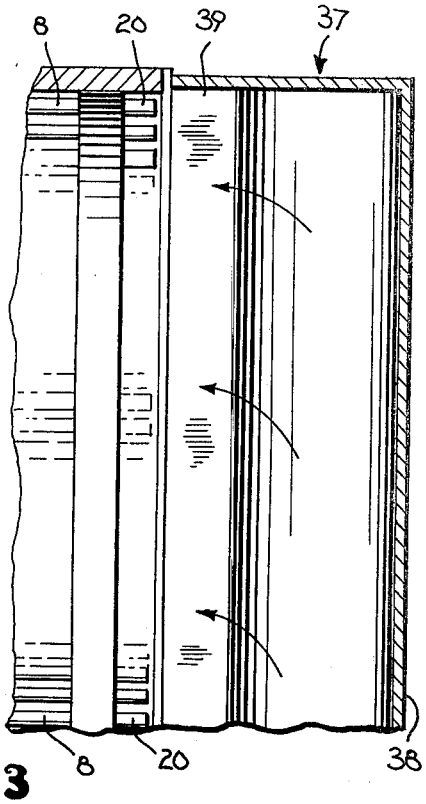
FIG. 3 is a partial longitudinal section of the rotary back-flow cover taken on line 3—3 of FIG. 2.

The present invention is directed to tube-type heat exchangers such as steam condensers used in turbo-electric generating plants. A schematic showing of such a facility is shown in FIG. 1. In that figure, a boiler 1 produces steam which is transferred to a turbine 2 which is caused to rotate and drive an electric generator 3. After the steam has done its work, it is transferred to a condenser 4 which converts the steam back to water, which is then transferred by a pump 5 back to boiler 1. Condenser 4 utilizes the cooling effect of cold water from a source 6 such as a lake which is circulated through the condenser housing at a given desired pressure by a pump 7. The condenser includes a plurality of tubes 8 through which the cooling water flows and upon which the steam impinges and thereupon condenses. In the condenser of FIG. 1, the cooling water flows in both directions therethrough before returning to its source 6, but in the embodiment to be described, the water normally flows only in one direction.

Figure 2:
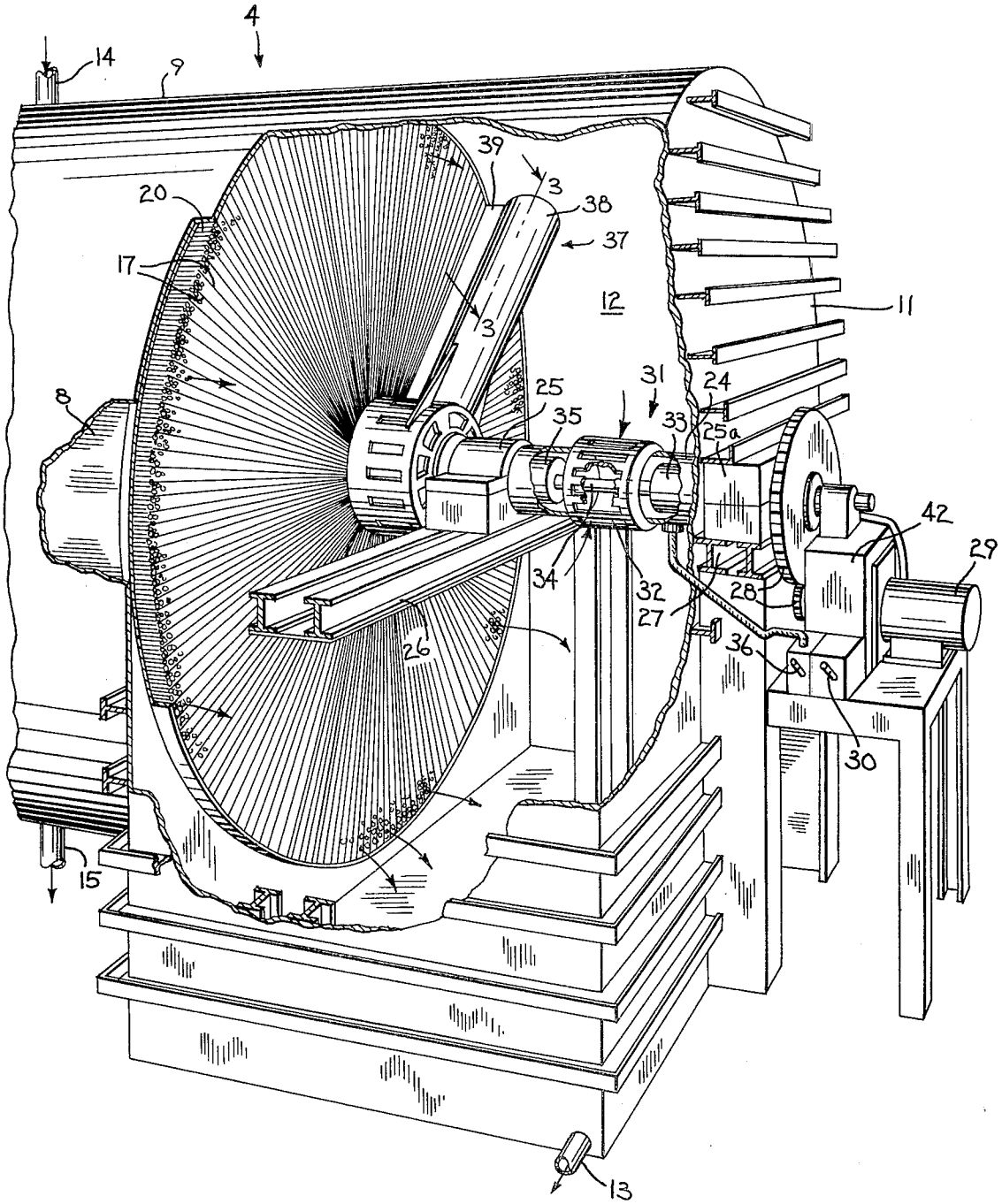
FIG. 2 is a schematic perspective view, with parts broken away, of a steam condenser which incorporated the concept of the invention.

FIG. 2 illustrates the downstream end portion of a heat exchanger of the steam condenser type with the condenser 4 having a housing 9 within which are disposed a very large plurality of individual tubes 8. These tubes extend from the upstream end of housing 9 (See FIG. 1) to an open terminus forming a vertical plane 10 which is spaced rearwardly from the housing front wall 11. This space forms a chamber 12.

Cooling water flowing through the tubes under pressure from pump 7 discharges at the tube terminus and flows through chamber 12 to a discharge pipe 13. The construction is such that chamber 12 is substantially filled with water during condenser operation.

When electricity is being generated, steam from turbine 2 passes into housing 9 through an inlet pipe 14, is condensed by contact with the cooling tubes 8, and is discharged through a pipe 15.

Figure 4:
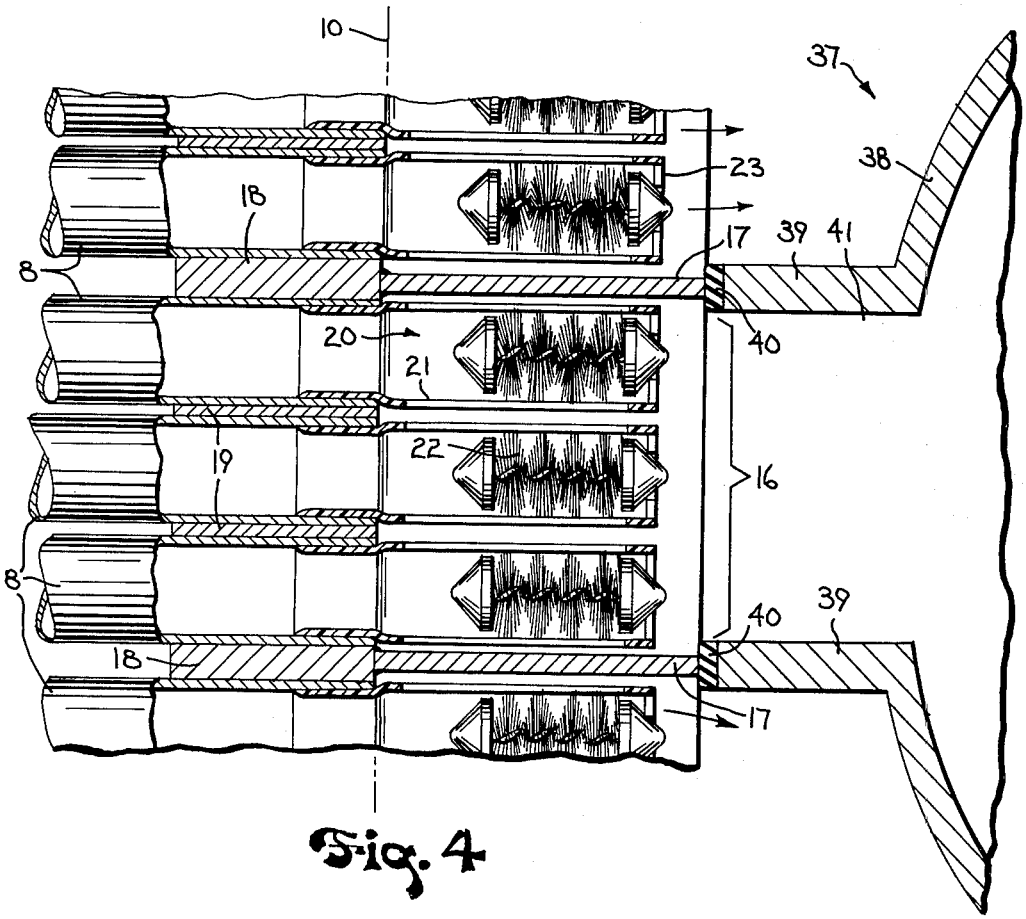
FIG. 4 is an enlarged partially sectional view showing the back-flow cover in registry with one of the tube compartments.

Referring to FIGS. 2 and 4, the downstream end portions only of tubes 8 are formed into a plurality of bundles 16 arrayed in side-by-side relationship. In the present embodiment, the bundles 16 together form a cylindrical mass, with each bundle having a radial extent from the center of the cylinder and being generally wedge-shaped. Bundles 16 are separated and compartmentalized at the downstream end of condenser 4 by a plurality of radially extending gradually converging flow confinement plates 17 which are secured, as by welding, to tube plate portions 18 and 19 disposed to hold tubes 8 in position. Tube plate portions 18 and 19 serve to prevent steam condensate and the water in chamber 12 from intermixing.

For purposes of cleaning the interior of tubes 8, the downstream terminus of each tube is provided with an assembly 20 which comprises an open cage or basket 21 within which is normally disposed a cleaning brush 22. Water flowing outwardly from the tube ends forces brushes 22 into engagement with a stop 23 on the basket. See the arrows in FIG. 4. Assemblies 20 may be permanently mounted to tubes 8 in any suitable manner, such as by a press fit. Brushes 22 are of such a size that they can pass through tubes 8, as will be described.

It is contemplated that similar baskets 21, not shown, are mounted on the upstream ends of tubes 8, for purposes to be described.

For cleaning the walls of tubes 8, it is desired to cause brushes 22 to move upstream through the tubes and then to reverse direction and return to the downstream baskets, thus providing two passes through each tube. This could be accomplished by using a water valve of the type disclosed in the aforementioned U.S. Pat. No. 3,973,592. However, due to the aforementioned disadvantages of valve size in certain installations, an improved system has been devised.

The substantially unlimited supply of water present in chamber 12 is utilized in a partial stream reversal technique to force brushes 22 upstream against the normal flow of coolant water.

For this purpose, and in the embodiment of FIGS. 2–6, a large rotor 24 is disposed within chamber 12 and is generally co-axial with housing 9 and the cylindrical mass of tubes 8. Rotor 24 is supported in any desirable way, such as by bearings 25, **25*a* which in turn are supported by respective frame portions 26, 27 connected to housing 9. The outer end portion of rotor 24 extends through front wall 11 and is connected through a series of reduction gears 28 to a drive motor 29 which thereby rotates the rotor. Motor 29 may be controlled in any suitable manner, such as by a manual on-off switch 30**.

Rotor 24 is generally hollow and contains an internal fluid conducting cavity. The inlet to the cavity comprises a cage-like element 31 having a plurality of longitudinally extending circumferentially disposed water inlet ports 32 which are incorporated in the midsection of the rotor. A pump motor 33 is disposed within rotor 24 outwardly from cage 31, with the motor having a drive shaft 34 extending axially through the cage to a pump 35 housed within the rotor inwardly from the cage. Motor 33 may be actuated in any suitable manner such as by manually operable on-off switch 36.

The cavity within rotor 24 leads inwardly from pump 35 to adjacent tubes 8 where it connects to a distributor arm assembly 37 mounted at one end to the inner end of rotor 24 and which extends radially outwardly along the tube ends. Arm 37 comprises a generally cylindrical hollow housing 38, the wall of which opens and faces toward a portion of tubes 8 and assemblies 20 by means of a pair of gradually converging spaced lips 39 having resilient sealing members 40 thereon, for purposes to be described. Lips 39 are circumferentially spaced apart the same distance as the width of the outer ends of each tube bundle 16, which coincides with the spacing between plates 17. The entire arm assembly 37 forms an elongated cover for adjacent tube ends, covers the tubes from the approximate center to the edge of the bundle, and forms a continuation of the fluid conducting cavity of rotor 24.

Actuation of motor 29 causes rotor 24 to rotate, carrying with it arm assembly 37 so that the water flow opening 41 formed by lips 39 progressively moves across the plurality of bundles 16 in succession. As lips 39 register with the edges of plates 17, as shown in FIG. 4, the bundle between lips 39 is at least partially sealed against members 40, although at least some leakage is to be expected and will not be harmful. Furthermore, in the event pump 35 is not operating, water pumped through tubes 8 by pump 7 will, when outside of lips 39, flow in the direction shown by the arrows in FIG. 4. The water between lips 39 will flow very little, if at all. Brushes 22 will be maintained in baskets 21.

When tubes 8 are to be cleaned, pump motor 33 is maintained in actuated condition so that pump 35 draws water from chamber 12 into ports 32 and pumps it through arm assembly 37 to the channel formed by lips 39. Since pump 35 is designed to provide a higher water pressure than the water pressure created at the tube ends by pump 7, which continues to operate, the water flowing through rotor 24 and assembly 37 will be forced rearwardly through tubes 8, opposing the normal water flow as shown in FIG. 5. Thus, a partial stream reversal of the fluid within chamber 12 is created, with high reverse positive flow pressure causing the brushes 22 under assembly 37 to pass out of their cages and be propelled upstream through the respective tubes for cleaning the latter. Brushes 22 will normally enter the aforementioned upstream baskets.

Assuming that rotor motor 29 is operating continuously during the cleaning cycle, arm assembly 37 gradually sweeps across the entire end face of the tube mass with lips 39 passing in and out of registry with adjacent plates 17. As arm assembly 37 passes out of registry with a particular group of tubes, as shown in FIG. 6, the reverse flow of water in the tubes is terminated so that cleaning brushes 22 are automatically forced forwardly by the normal primary water flow and ultimately return to their baskets 21.

If desired, arm assembly 37 may be caused to move intermittently from bundle to bundle, with a timed stop at each bundle. This may be accomplished in any suitable well-known manner, such as by a timer operated intermittent clutching indexing device 42 interposed between motor 29 and gears 28.

Figure 7:
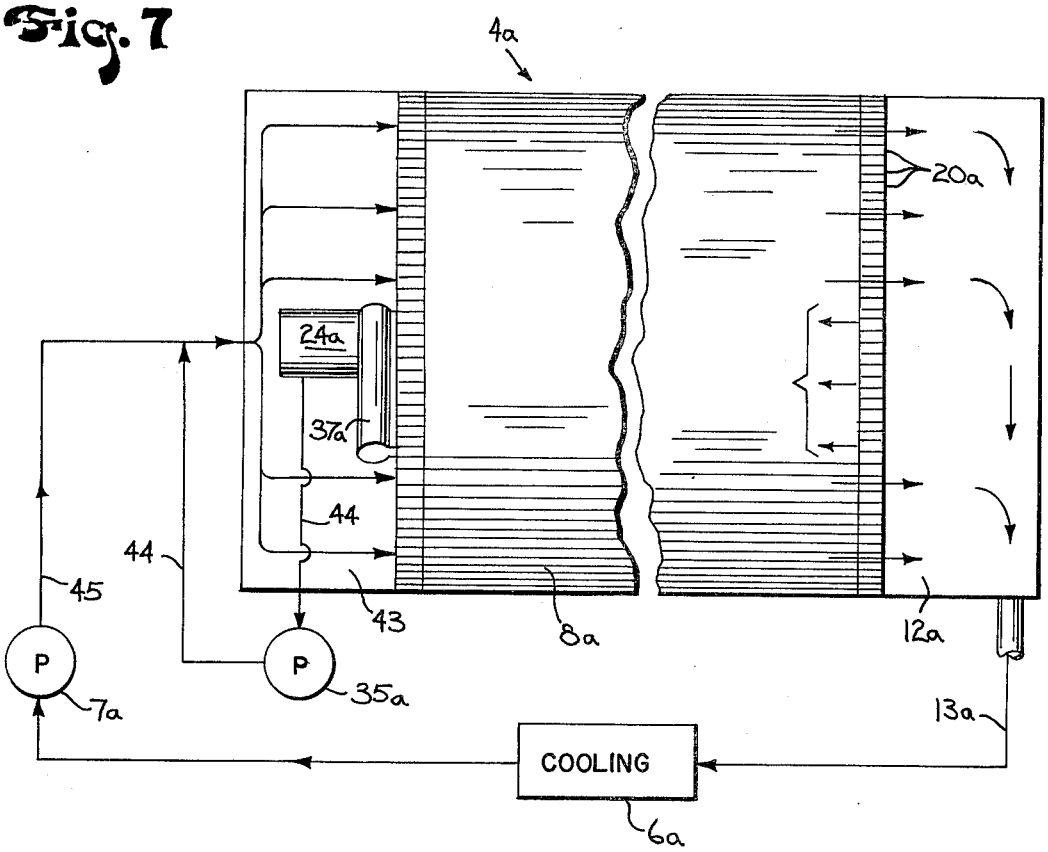
FIG. 7 is a schematic showing of a second embodiment.

FIG. 7 schematically illustrates another embodiment utilizing the concepts of this invention. In this embodiment, the condenser 4*a* is generally similar to that of FIGS. 1 and 2, with a plurality of cooling tubes 8*a*, and a downstream chamber 12*a* into which the cooling water is discharged. The water then flows through line 13*a* back to the cooling source 6*a*. In this instance, only the upstream ends of tubes 8*a* are similarly compartmentalized and the downstream tube ends have brush assemblies 20*a* thereon. A motor driven rotor 24*a* having a radial distributor arm assembly 37*a* in an upstream flow chamber 43 is also provided.

In this instance pump 35*a* and its associated drive are disposed in a water line 44 connected at one end to the main input line 45 (connected to main pump 7*a*) upstream of condenser 4*a* and at the other end to rotor 24*a*, which is generally imperforate, and thus also to distributor 37*a*. The pump 35*a* is adapted to pump water from the distributor area and back into input line 45. This creates a high suction or negative flow pressure at the compartmentalized tube ends over which distributor 37*a* is disposed at any given time. Thus, water in those particular tubes will be sucked upstream against the downstream flow, carrying the cleaning brushes therealong. The effect is the same as in FIGS. 2–6.

Figure 8:
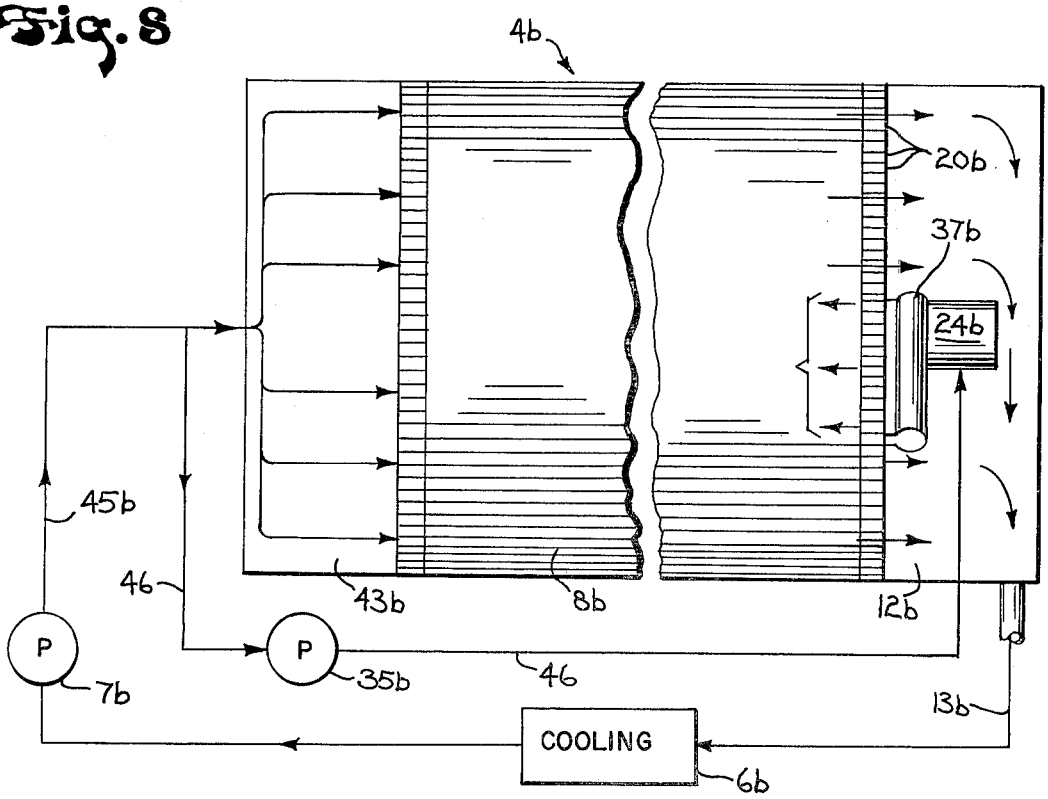
FIG. 8 is a schematic showing of a third embodiment.

FIG. 8 schematically illustrates yet another embodiment wherein the placement of many of the elements remains the same as in FIGS. 2–6. In this instance the water input 31 opening into chamber 12 of FIG. 2 is eliminated. Instead, pump 35*b* and its associated drive are disposed in a water line 46 which is connected at one end to the main input line 45*b* upstream of condenser 4*b* and at the other end to a generally imperforate rotor 24*b* and hence to distributor 37*b*. The pump 35*b* is adapted to pump water from main line 45*b* to rotor 24*b* and hence to distributor 37*b* so that high pressure positive reverse flow is created as in the first embodiment.

In some instances the tube mass within the condenser housing may be shaped other than cylindrical, such as rectangular. In such instance, the arm assembly may be designed to sweep linearly across the tube ends instead of circularly.

The invention provides a unique continuous selective counter-flow technique using water from the main cooling stream and whereby opposing water is progressively interjected into adjacent compartmentalized tubes in succession to clean the internal portions of the tubes via reciprocating brushes. The reversal of fluid flow in the tubes, and the return to normal flow, are automatic in response to arm movement across the tube ends, the flow changes not being dependent on complex valves or motor and pump reversals.

Because only a small percentage of the water in the main cooling stream is utilized in the reversal process, the main water flow is not appreciably disturbed.

Various modes of carrying out the invention are contemplated as being within the scope of the following claims particularly pointing out and distinctly claiming the subject matter which is regarded as the invention.

I claim:

1. In a device of the character described:

(a) a heat exchanger housing, (b) main cooling fluid input and output lines connected to said housing, (c) fluid supply means operable to provide main cooling fluid flow at a given pressure through said input line and said housing to said output line, (d) a plurality of tubes disposed within said housing for carrying said main cooling fluid in a downstream direction from said input line to said output line, said tubes having upstream and downstream ends, (e) cleaning assemblies mounted on the downstream ends of said tubes and with said assemblies including tube cleaning brushes, (f) means disposed at only one end of said tubes for compartmentalizing said tubes into a plurality of bundles, (g) a fluid counter-flow cover disposed in facing relationship with a portion of the compartmentalized tube ends, (h) fluid flow reversal means connected to said cover for reversing the downstream direction of flow of only a part of said main cooling fluid at the downstream tube ends during operation of said fluid supply means and providing a fluid back-flow upstream through said tubes at a pressure greater than said given pressure and against the normal flow of said main cooling fluid to thereby carry said brushes upstream therewith, (i) and means to move said cover progressively across the said bundles of tube ends so that a portion of the said brushes is automatically directed upstream with said reverse flow and so that said last-named brushes automatically return downstream with said cooling fluid when said cover passes from over said bundles.

2. The device of claim 1:

(a) wherein said tube compartmentalizing means and said cover are disposed at the downstream ends of said tubes, (b) and wherein said fluid flow reversal means (h) comprises a pump fluidically connected between said output line and said lover and adapted to cause fluid flow upstream toward said cover.

3. The device of claim 1:

(a) wherein said tube compartmentalizing means and said cover are disposed at the upstream ends of said tubes, (b) and wherein said fluid flow reversal means (h) comprises a pump fluidically connected between said cover and said input line and adapted to cause fluid flow upstream from said cover and its adjacent tubes and toward said input line.

4. The device of claim 1:

(a) wherein said tube compartmentalizing means and said cover are disposed at the downstream ends of said tubes, (b) and wherein said fluid flow reversal means (h) comprises a pump fluidically connected between said input line and said cover and adapted to cause fluid flow from said last-named line to said cover.

* * * * *

UNITED STATES PATENT AND TRADEMARK OFFICE

CERTIFICATE OF CORRECTION

PATENT NO. : 4,269,264

DATED : May 26, 1981

INVENTOR(S) : RICHARD W. GOELDNER

It is certified that error appears in the above-identified patent and that said Letters Patent are hereby corrected as shown below:

| | |
|---|---|
| Cover (Foreign Patent Documents) | Delete "41-29929" (Japanese citing) and substitute therefor ----44-29929---- |
| Column 2, Line 26 | Delete "incorporated" and substitute therefor ----incorporates---- |
| Column 6, Line 43 | Delete "lover" and substitute therefor ----cover---- |

Signed and Sealed this

*Eighth* Day of *September 1981*

[SEAL]

*Attest:*

GERALD J. MOSSINGHOFF

*Attesting Officer*

*Commissioner of Patents and Trademarks*